US005347731A

United States Patent [19]

Iwama

[11] Patent Number: 5,347,731

[45] Date of Patent: Sep. 20, 1994

[54] SKI BOOT WITH AN INNER FOOT PRESSER

[75] Inventor: Shinichi Iwama, Tokyo, Japan

[73] Assignee: Daiwa Seiko, Inc., Tokyo, Japan

[21] Appl. No.: 77,499

[22] Filed: Jun. 17, 1993

Related U.S. Application Data

[63] Continuation of Ser. No. 763,615, Sep. 23, 1991, abandoned.

[30] Foreign Application Priority Data

Oct. 16, 1990 [JP] Japan ..... 2-278892

[51] Int. Cl.[5] ..... A43B 5/04

[52] U.S. Cl. ..... 36/119; 36/117

[58] Field of Search ..... 36/117–121, 36/88, 93, 97, 50, 50.1, 50.5

[56] References Cited

U.S. PATENT DOCUMENTS 5,020,248 6/1991 Hercog et al. ..... 36/117

FOREIGN PATENT DOCUMENTS 3808652 11/1988 Fed. Rep. of Germany ..... 36/117
2381483 10/1978 France ..... 36/119
2469885 6/1981 France ..... 36/119
63-103401 7/1988 Japan .

*Primary Examiner*—Paul T. Sewell
*Assistant Examiner*—Thomas P. Hilliard
*Attorney, Agent, or Firm*—Longacre & White

[57] ABSTRACT

The instant invention is directed to a ski boot having a holding device in which the force for fastening a front foot portion can be adjusted. The ski boot has a screw portion provided on an adjusting rod for adjusting the fastening force. The ski boot according to the present invention, further includes an adjusting member provided to the first end portion of the adjusting rod projected outward from the outer shell, for applying a fastening force to the foot holding member through the pressing members so as to press the inner foot and fasten a front foot portion, and for releasing the foot holding member from the fastening force through the pressing members by one-touch operation.

8 Claims, 3 Drawing Sheets

SKI BOOT WITH AN INNER FOOT PRESSER

This is a continuation of application Ser. No. 07/763,615, filed Sep. 23, 1991, which was abandoned upon the filing hereof.

BACKGROUND OF THE INVENTION

1. Field of the Invention

The present invention relates to ski boots, and particularly relates to ski boots each having a holding device in which the force for fastening a front foot portion can be adjusted.

2. Description of the Prior Art

Conventionally, in each of some ski boots, there is provided a holding device for fastening a front foot portion with optimum force so as to eliminate unnecessary looseness to thereby integrate a foot and the ski boot to improve ski-operating property.

As such ski boots, for example, those as disclosed in Japanese Utility Model Unexamined Publication No. Sho-63-103401 have been known.

In each of the ski boots disclosed in the above Japanese Utility Model Unexamined Publication has a configuration in which: a foot holding member is provided between an outer shell and an inner boot inserted into the outer shell, the foot holding member having slant surfaces provided on the left and right sides of a central support portion, and having pressing portions provided at opposite end portions of the foot holding member so as to press the inner boot; opposite end portions of a screw rod penetrating the slant surfaces of the foot holding member in the left/right directions are rotatably supported by the outer shell; nut members screwed onto inverse herical male screw portions formed on the screw rod at its opposite end portions respectively are engaged with the slant surfaces in the rotation-prevention state; and an adjusting lever is pivoted at one end portion of the screw rod externally projected out from the outer shell.

In such a ski boot, when the adjusting lever is operated to rotate, the pressing portions of the foot holding member press the inner boot to thereby fasten a front foot portion with optimum fastening force to eliminate unnecessary looseness to thereby integrate a foot and the ski boot to improve the ski-operating property.

Generally, skiing, lift-riding, resting in a lodge, etc., are performed in the state where a skier puts on a pair of ski boots. Such a state in which a front foot portion is fastened to eliminate unnecessary looseness to thereby integrate a foot and the ski boot is however unnecessary in the lift riding time, in the resting time in the lodge, etc., excepting in the skiing time.

In the above ski boot, there has been a problem that it is necessary to operate the adjusting lever provided on the screw rod to rotate so as to reduce the fastening force of the foot holding member every time when it becomes unnecessary to fasten the front foot portion with the fastening force. Thus, the operation is extremely troublesome. Particularly, it has been a problem that it is extremely troublesome for a skier to reduce the fastening force under the severe cold condition on the skiing ground or the like and in the state where the skier wears gloves.

SUMMARY OF THE INVENTION

It is therefore an object of the present invention to solve the above problems. It is another object of the present invention to provide a ski boots in each of which a front foot portion can be fastened with optimum fastening force and the front foot portion can be released from the fastening force through one-touch operation when the fastening becomes unnecessary.

In order to attain the above objects, according to the present invention, the ski boot comprises: an outer shell; an inner boot inserted into the outer shell; a foot holding member provided between the outer shell and the inner boot, the foot holding member including a central support portion, slant surfaces provided on the horizontally opposite sides of the central support portion, and pressing portions provided at opposite end portions of the central support portion for pressing the inner boot; an adjusting rod provided so as to horizontally penetrate the slant surfaces of the foot holding member, the adjusting rod being rotatably supported at a first and a second end portions thereof by the outer shell; pressing members outer-inserted onto the adjusting rod so as to press the slant surfaces from the opposite sides thereof, so that the pressing portions of the foot holding member press the inner boot when the pressing members are moved so as to approach each other; and adjusting member provided to the first end portion of the adjusting rod projected outward form the outer shell, for applying a fastening force to the foot holding member through the pressing members so as to press the inner boot and fasten a front foot portion, and for releasing the foot holding member from the fastening force through the pressing members by one-touch operation.

In the ski boot according to the present invention, when the adjusting lever is turned, the adjusting rod is rotated so that the other-side pressing member screwed with the male screw portion is moved in the axial direction of the adjusting rod so as to be held at a fixed position.

When the adjusting lever is pushed down, the movable member is pressed toward the slant surfaces by the eccentric cam, and the one-side pressing member is pressed by the spring member against the slant surface of the foot holding member so that the one-side pressing member and the other-side pressing member are caused to approach each other. This movement is converted into the downward movement of the pressing portions of the foot holding member so that the inner boot is pressed to thereby fasten a front foot portion.

On the other hand, when the adjusting lever is raised, the movable member which has been pressed toward the slant surface is pressed toward the eccentric cam by the spring member so that the small-diameter portion of the movable member is made loose in the insertion hole formed through the shell body. At the same time, the urging force of the spring member is reduced so that the one- side pressing member is moved toward the adjusting lever, and the pressing members are separated from each other. This movement is converted into the upward movement of the pressing portions of the foot holding portion by the slant surfaces, and the force for fastening the front foot portion is momentarily released.

DETAILED DESCRIPTION OF PREFERRED EMBODIMENTS

The present invention will be described in detail hereunder with respect to an embodiment illustrated in the accompanying drawings.

Figure 1:
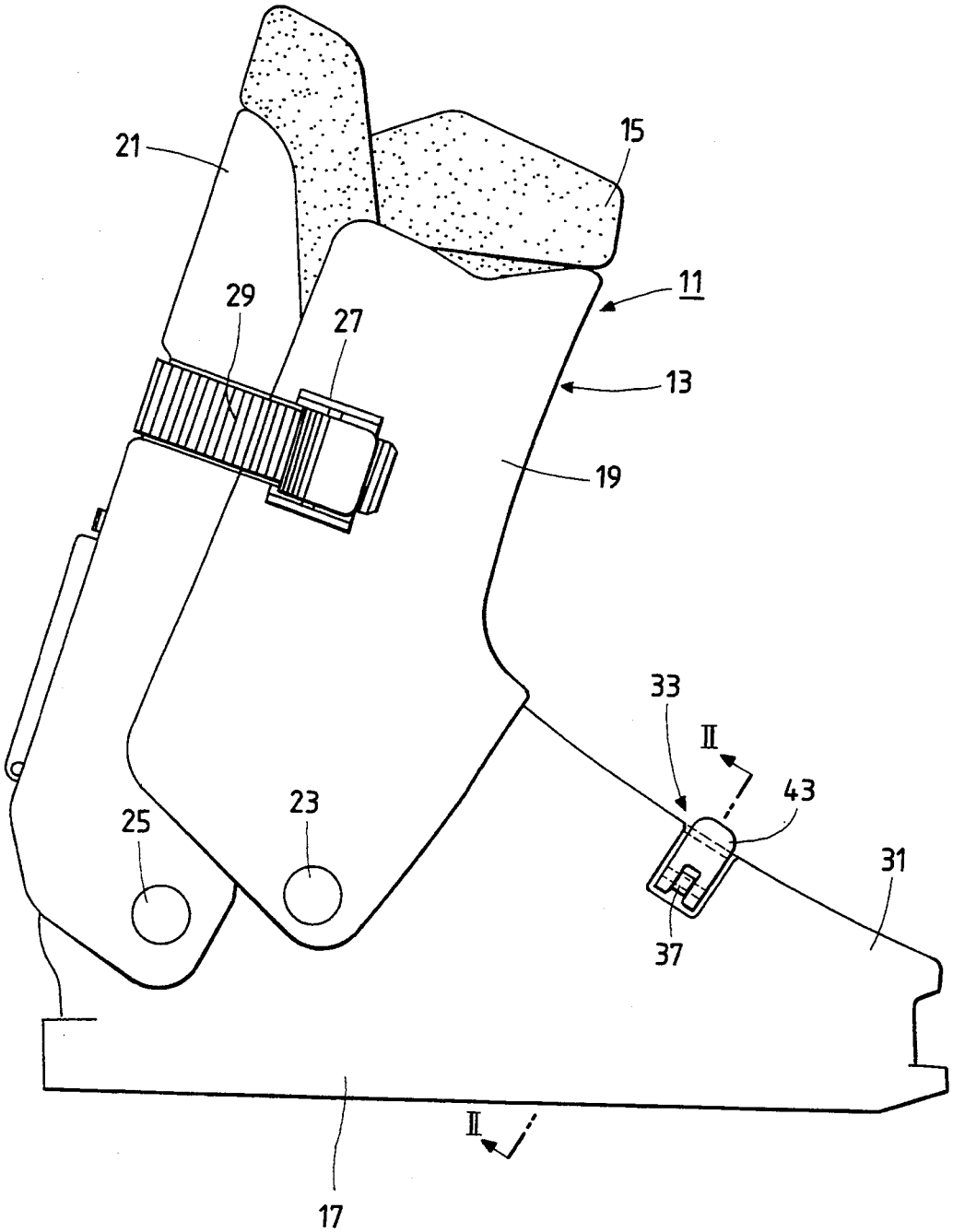
FIG. 1 is a side view showing an embodiment of the ski boot according to the present invention.

FIG. 1 is a schematic view showing an embodiment of one of a pair of ski boots according to the present invention. In FIG. 1, the reference numeral 11 designates a ski boot body.

Briefly, the ski boot body 11 is constituted by an outer shell 13 made of a hard and tough synthetic resin material and an inner boot 15 inserted into the outer shell 13.

The outer shell 13 is constituted by a shell body 17 for mainly covering a portion of foot lower than an ankle, a front calf 19 for covering a portion of leg from the ankle portion to a shank portion, and a rear calf 21 for covering a portion of leg from an upper portion of a heel to a calf portion.

The front calf 19 is pivoted at its lower end to the inner and outer ankle portions of the shell body 17 by pivot pins 23 respectively so that the front calf 19 can slant forward. The rear calf 21 is pivoted at its lower end to the ankle covering portion of the shell body 17 by pivot pins 25 so that the rear calf 21 can be released backward.

A fastening buckle 27 is fixed on the one-side upper surface of the front calf 19. One end of a fastening band 29 to be engaged with the buckle 27 is fixed on the other-side upper surface of the front calf 19 at a position in opposition to the buckle 27. The fastening band 29 is wound around the outer periphery of the rear calf 21, and then coupled or engaged at its free end portion with the buckle 27 to thereby integrate the front calf 19 and the rear calf 21 with each other.

A holding device 33 for fastening a front foot portion is mounted on the shell body 17.

Figure 2:
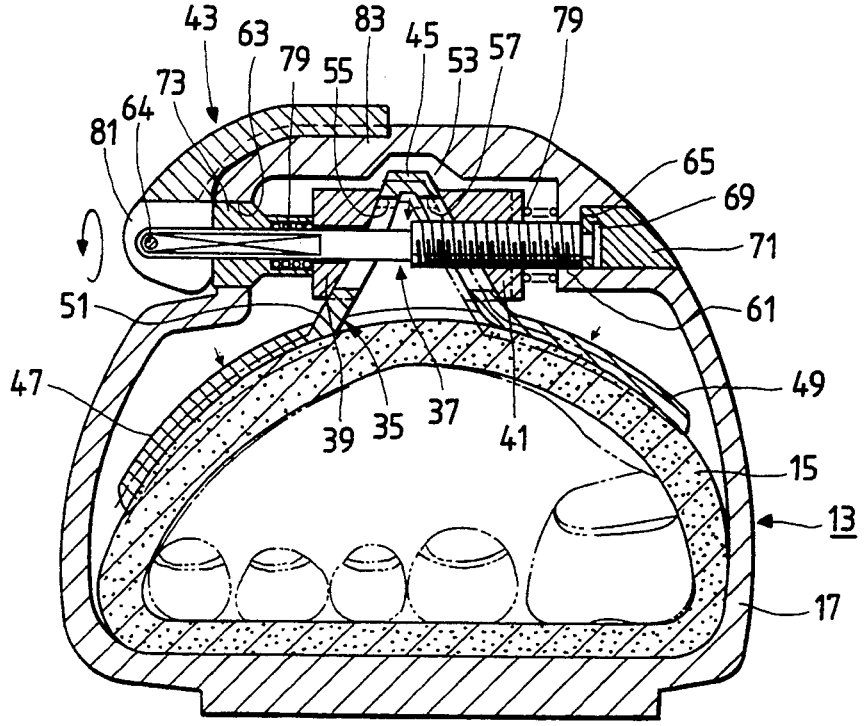
FIG. 2 is a cross-section taken along a line II—II of FIG. 1.
Figure 3:
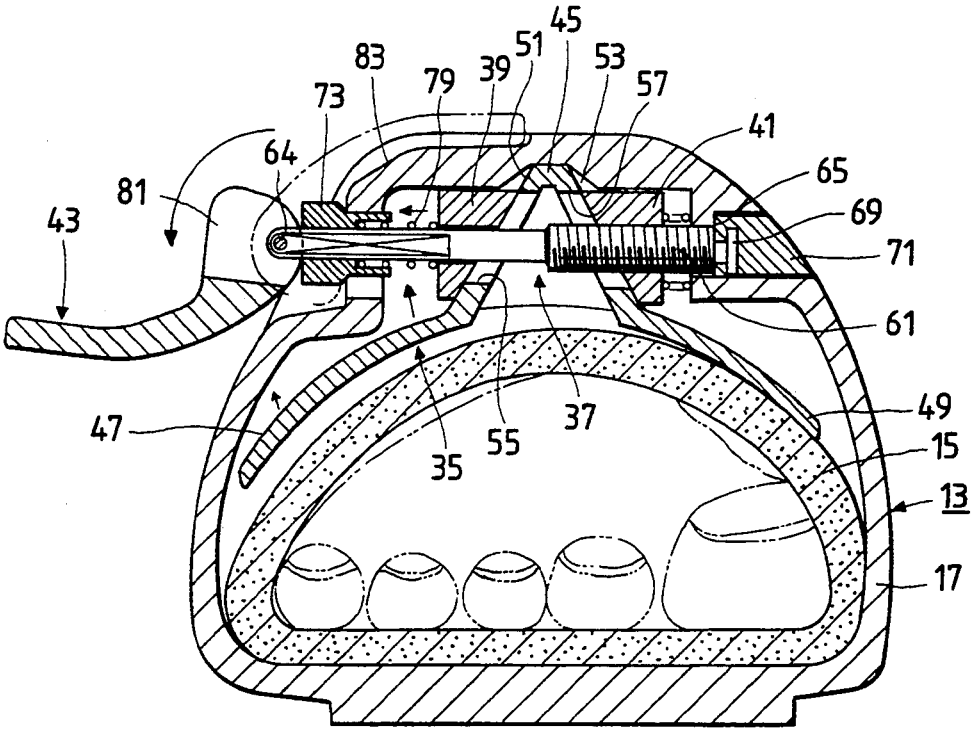
FIG. 3 is a cross-section of the ski boot in the state in which an adjusting lever is raised.
Figure 4:
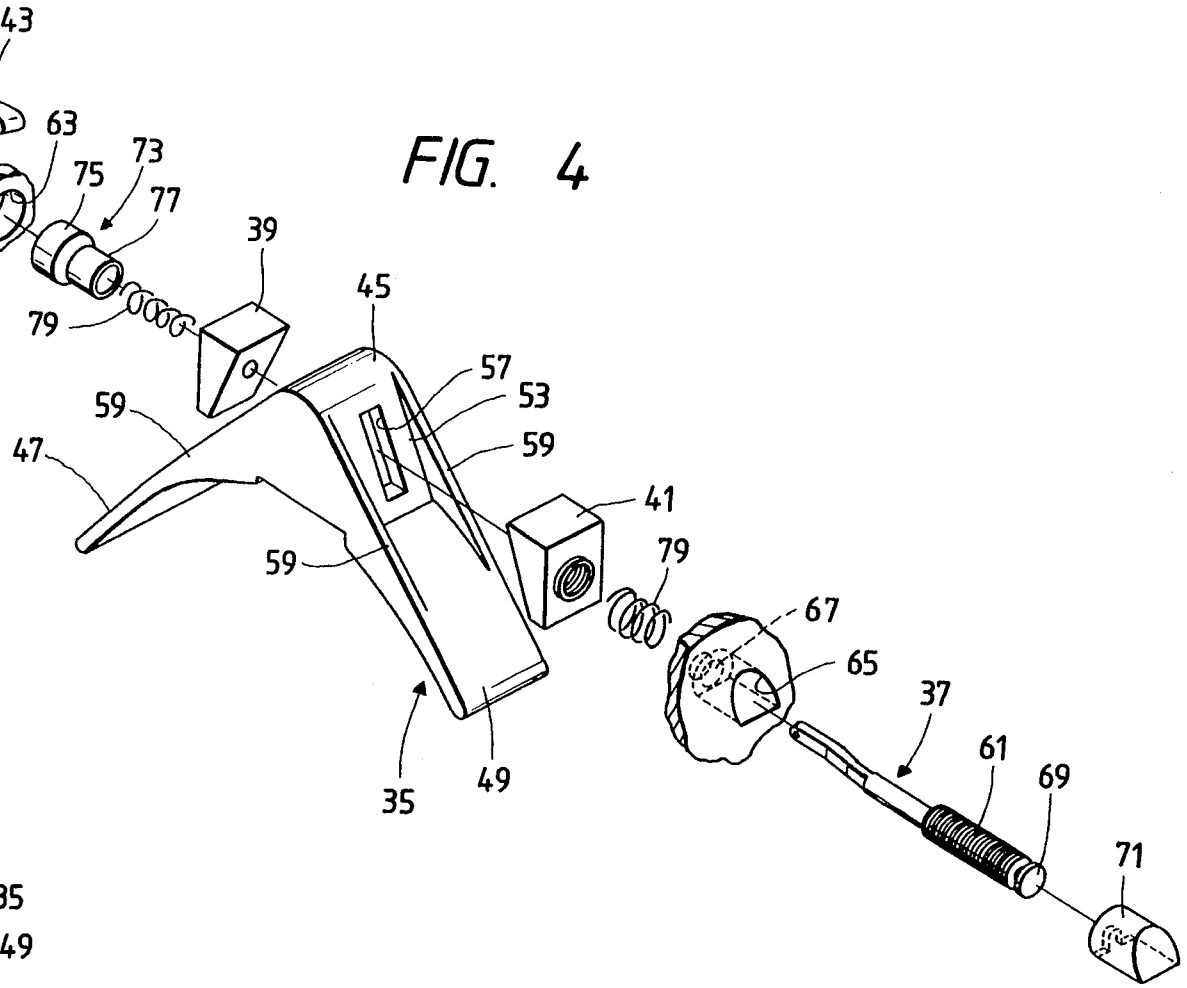
FIG. 4 is an exploded perspective view of the holding device in FIG. 2.

As shown in FIGS. 2 through 4, the holding device 33 is constituted by a foot holding member 35, an adjusting rod 37, one-side and other-side pressing men%hers 39 and 41 which are outer-inserted onto the adjusting rod 37, and an adjusting lever 43 provided on the adjusting rod 37 at its one-side end portion.

The foot holding member 35 is constituted by a central support portion 45 shaped like a mountain, and pressing portions 47 and 49 provided continuously to the left and right lower ends of the central support portion 47 respectively and extended so as to abut on of the inner boot 15 on the upper surface thereof and the left and right side surface portions thereof continued to the upper surface.

Elongated holes 55 and 57 through which the adjusting rod 37 is inserted are formed in the up/down direction in the left and right slant surfaces 51 and 53 of the central support portion 45 respectively. Further, the slant surfaces 51 and 53 are formed as flat sliding portions on which the pressing members 39 and 41 are slid in the up/down direction. Edge portions 59 serving also as reinforcement of the pressing portions 47 and 49 are formed on the front and back portions of the sliding portions respectively. The pressing members 39 and 41 are engaged with the respective pairs of edge portions 59, so that the pressing members 39 and 41 are prevented from turning.

The adjusting rod 37 is disposed in the up/down direction in the shell body 17. A male screw portion 61 to be screwed into the other-side pressing member 41 is formed on the adjusting rod 37.

One end portion of the adjusting rod 37 penetrates an insertion hole 63 formed in the shell body 17 so as to project out from the shell body 17. The adjusting lever 43 is rotatably pivoted by a pin onto an projecting end portion of the adjusting rod 37.

Further, the other end portion of the adjusting rod 37 penetrates an insertion hole 67 formed in a concave portion 65 of the shell body 17 so as to project out from the shell body 17. A fall-prevention portion 69 is formed on the adjusting rod 37 at its projecting end portion. The fall-prevention portion 69 is rotatably engaged by a fall-prevention holding member 71 received in the concave portion 65 of the shell body 17.

Further, the one-side pressing member 39 on the adjusting lever 43 side is outer-inserted onto the adjusting rod 37 movably in the axial direction of the adjusting rod 37. The other-side pressing member 41 on the side opposite to the adjusting lever 43 is screwed with the male screw portion 61 of the adjusting rod 37 as described above. The pressing members 39 and 41 are made to abut on the sliding portions so as to press the slant surfaces 51 and 53 of the foot holding member 35 from the opposite sides thereof.

A movable member 73 is axially movably outer-inserted onto the adjusting rod 37 at a position between the adjusting lever 43 and the one-side pressing member 39.

The movable member 73 is constituted by a large-diameter portion 75 and a small-diameter portion 77. The large-diameter portion 75 of the movable member 73 may be inserted through an insertion hole 63 of the shell body 17. Further, an inside portion of the small-diameter portion 77 of the movable member 73 is made hollow. A spring member 79 is received in the inside hollow portion of the small-diameter portion 77. The spring member 79 is made to abut on the one-side pressing member 39 so that the movable member 73 is always urged toward the adjusting lever 43.

Further, a spring member 79 is interposed between the other-side pressing member 41 and the shell body 17 so that the adjusting rod 37 is axially restricted so as not to move to the outside of the shell body, 17.

An eccentric cam 81 is formed on the basic portion of the adjusting lever 43 so that the cam 81 presses the movable member 73 toward the slant surface 51 to make the pressing members 39 and 41 approach each other, while the cam 81 releases the approaching state of the pressing members 39 and 41 when the adjusting lever 43 is raised.

That is, a concave portion 83 for receiving the adjusting lever 43 is formed in the outer surface of the shell body 17. The eccentric cam 81 of the adjusting lever 43 is formed such that the distance from the connection position between the adjusting rod 37 and the eccentric cam 81 to the surface on which the eccentric cam 81 abuts on the movable member 73 becomes longest when the adjusting lever 43 is received within the receiving concave portion 83 as shown in FIG. 2, while the distance from the connection position between the adjusting rod 37 and the eccentric cam 81 to the surface on which the eccentric cam 81 abuts on the movable member 73 becomes shortest when the adjusting lever 43 is raised up from the receiving concave portion 83 as shown in FIG. 3.

In the ski boot having such a configuration as illustrated, when the adjusting lever 43 is turned, the adjusting rod 37 is rotated so that the other-side pressing member 41 screwed with the male screw portion 61 is moved in the axial direction of the adjusting rod 37 so as to be held at a fixed position.

As shown in FIG. 2, when the adjusting lever 43 is pushed down, the movable member 73 is pressed toward the slant surfaces 51 and 53 by the eccentric cam 81, and the one-side pressing member 39 is pressed by the spring member 79 against the slant surface 51 of the foot holding member 35 so that the one-side pressing member 39 and the other-side pressing member 41 are caused to approach each other. This movement is converted into the downward movement of the pressing portions 47 and 49 of the foot holding member 35 so that the inner boot 15 is pressed to thereby fasten a front foot portion.

On the other hand, as shown in FIG. 3, when the adjusting lever 43 is raised, the movable member 73 which has been pressed toward the slant surface 51 is pressed toward the eccentric cam 81 by the spring member 79 so that the small-diameter portion 77 of the movable member 73 is made loose in the insertion hole 63 formed through the shell body 17. At the same time, the urging force of the spring member 79 is reduced so that the one-side pressing member 39 is moved toward the adjusting lever 43, and the pressing members 39 and 41 are separated from each other. This movement is converted into the upward movement of the pressing portions 47 and 49 of the foot holding portion 35 by the slant surfaces 51 and 53, and the force for fastening the front foot portion is momentarily released.

Thus, in the ski boot having such a configuration as described above, the one-side pressing member 39 is axially movably outer-inserted onto the adjusting rod 37, the other-side pressing member 41 is screwed onto the male screw portion 61 of the adjusting rod 37, the movable member 73 is axially movably outer- inserted onto the adjusting rod 37 at a position between the adjusting lever 43 and the one-side pressing member 39, the spring member 79 is provided between the movable member 73 and the one-side pressing member 39, and the eccentric cam 81 for releasing the approaching state of the pressing members 39 and 41 in the state of raising the adjusting lever 43 is formed on the adjusting lever 43 at its base portion, so that a front foot portion can be fastened by the most suitable fastening force in skiing, and the front foot portion can be released from the fastened state by one-touch operation in the case other than skiing, that is, when a skier is riding on a lift, rests in a lodge, and so on. Accordingly, it is possible to prevent the front foot portion from being unnecessarily suppressed. Further, the front foot portion can be released from the fastened state under sever cold condition on a skiing ground, and further in the state where a skier wears his or her gloves.

Although the case in which the holding device 33 is provided on a rear-entry-type ski boot has been described by way of example in the embodiment, the present invention is not limited to this embodiment. It is a matter of course that the holding device may be provided on a front-entry-type ski boot.

Figure 5:
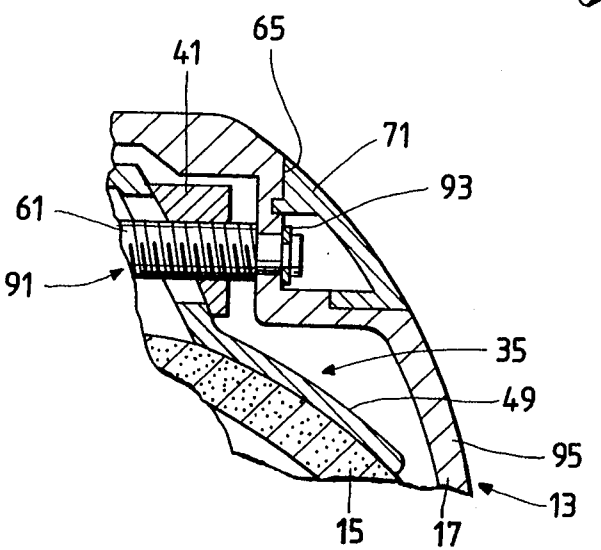
FIG. 5 is a cross-section showing the state in which the other end portion of the adjusting rod is engaged by another method.

Further, although the case in which the fall-preventing portion 69 is formed on the adjusting rod 37 at the other end portion and in which the fall-prevention portion 69 is engaged with the fall-prevention-portion holding member 71 received in the concave portion 65 of the shell body 17 has been described by way of example in the embodiment, the present invention is not limited to the embodiment. As shown in FIG. 5, an annular fall- prevention member 93 may be engaged with an adjusting rod 91 at the other end portion, and the fall-prevention member 93 may be engaged with a shell body 95 at its outer surface. Further, so long as the other end portion of the adjusting rod 91 is rotatably engaged, any configuration may be used.

In the ski boot according to the present invention, the one- side pressing member on the adjusting lever side is axially movably outer-inserted onto the adjusting rod, the other-side pressing member on the side opposite to the adjusting lever is screwed onto the male screw portion of the adjusting rod, the movable member is axially movably outer-inserted onto the adjusting rod at a position between the adjusting lever and the one-side pressing member, the spring member for urging the movable men, her toward the adjusting lever is provided between the movable member and the one-side pressing member, and the eccentric cam for pressing the movable member toward the slant surface so as to cause the pressing members to approach each other and for releasing the approaching state of the pressing members when the adjusting lever is raised, so that when the adjusting lever is turned, the adjusting rod is rotated so that the other-side pressing member screwed with the male screw portion is moved in the axial direction of the adjusting rod so as to be held at a fixed position. When the adjusting lever is pushed down, the movable member is pressed toward the slant surfaces by the eccentric cam, and the one-side pressing member is pressed by the spring member against the slant surface of the foot holding member so that the one-side pressing member and the other-side pressing member are caused to approach each other. This movement is converted into the downward movement of the pressing portions of the foot holding member so that the inner boot is pressed to thereby fasten a front foot portion.

On the other hand, when the adjusting lever is raised, the movable member which has been pressed toward the slant surface is pressed toward the eccentric cam by the spring member so that the small-diameter portion of the movable member is made loose in the insertion hole formed through the shell body. At the same time, the urging force of the spring member is reduced so that the one- side pressing member is moved toward the adjusting lever, and the pressing members are separated from each other. This movement is converted into the upward movement of the pressing portions of the foot holding portion by the slant surfaces, and the force for fastening the front foot portion is momentarily released.

Accordingly, the front foot portions can be fastened by optimum fastening force, and the front foot portions can be released from the fastened state in an unnecessary time.

What is claimed is:

1. A ski boot comprising:

an outer shell;

an inner boot inserted into said outer shell;

a foot holding member provided between said outer shell and said inner boot, said foot holding member including a central support portion, slant surfaces provided on the horizontally opposite sides of said central support portion, and pressing portions provided at opposite end portions of said central support portion for pressing said inner boot;

an adjusting rod provided so as to horizontally penetrate said slant surfaces of said foot holding member, said adjusting rod being rotatably supported at a first and a second end portions of said adjusting rod by said outer shell;

a first pressing member slidingly disposed for translation in an axial direction without relative rotation with respect to said adjusting rod, said first pressing member is provided between said foot holding member and said first end portion of said adjusting rod, a second pressing member threadingly engaged with said adjusting rod and provided between said foot holding member and said second end portion of said adjusting rod, and adjusting means provided to the first end portion of said adjusting rod projected outward from said outer shell, for applying a fastening force to said foot holding member through said pressing members so as to press said inner boot and fasten a front foot portion in a first position, and for releasing said foot holding member from the fastening force through said pressing members in a second position.

2. A ski boot according to claim 1, wherein said adjusting means comprises:

an adjusting lever pivotally provided to the first end portion of said adjusting rod, said adjusting lever having a base portion; and an eccentric cam provided on said base portion, wherein said cam is capable of applying the fastening force to the front foot portion in said first position, and releasing the approaching state of said pressing members when said adjusting lever is in said second position.

3. A ski boot according to claim 1, further comprising: a movable member slidingly disposed onto said adjusting rod so as to be movable in the axial direction of said adjusting rod and provided between said adjusting means and said first pressing means.

4. A ski boot according to claim 3 wherein said movable member comprises first and second circular portions, said first circular portion having a diameter larger than said second circular portion.

5. A ski boot according to claim 3 wherein said first circular portion is disposed in an opening provided in said outer shell in said first position of said adjusting means and said second circular portion is disposed in said opening in said second position of said adjusting means.

6. A ski boot comprising:

an outer shell;

an inner boot inserted into said outer shell;

a foot holding member provided between said outer shell and said inner boot, said foot holding member including a central support portion, slant surfaces provided on the horizontally opposite sides of said central support portion, and pressing portions provided at opposite end portions of said central support portion for pressing said inner boot;

an adjusting rod provided so as to horizontally penetrate said slant surfaces of said foot holding member, said adjusting rod being rotatably supported at a first and a second end portions thereof by said outer shell;

a first pressing member slidingly disposed onto said adjusting rod in an axial direction and provided between said foot holding member and said first end portion of said adjusting rod, a second pressing member threadingly engaged with said adjusting rod and provided between said foot holding member and said second end portion of said adjusting rod, adjusting means, provided at the first end portion of said adjusting rod and projected outward from said outer shell, for applying a fastening force to said foot holding member through said pressing members so as to press said inner boot and fasten a front foot portion in a first position, and for releasing said foot holding member from the fastening force through said pressing members in a second position, a movable member slidingly disposed onto said adjusting rod in the axial direction and provided between said adjusting means and said first pressing member, and spring means provided between said movable member and said first pressing member for urging said movable member toward said adjusting means.

7. A ski boot comprising:

an outer shell;

an inner boot inserted into said outer shell;

a foot holding member provided between said outer shell and said inner boot, said foot holding member including a central support portion, a slant surface on either side of said central support portion, and pressing portions provided at end portions distal from said central support portion, said pressing portions pressing said inner boot;

an adjusting rod penetrating both said slant surfaces of said foot holding member, said adjusting rod having first and second opposite end portions;

first mounting means for permitting relative rotation and substantially eliminating axial translation of said first end portion with respect to said outer shell;

second mounting means for permitting relative rotation of said second end portion with respect to said outer shell, said second mounting means axially translating with respect to said adjusting rod;

a first pressing member slidingly disposed for axial translation with respect to said adjusting rod, said first pressing member is between said second mounting means and said foot holding member;

a second pressing member threadingly engaged with said adjusting rod for setting a foot fastening force, said second pressing member is between said foot holding member and said first end portion of said adjusting rod; and, adjusting means for applying and releasing said foot fastening force on said inner boot through said pressing members acting on said slant surfaces, said adjusting means is on said second end portion of said adjusting rod projected outward from said outer shell.

8. The ski boot according to claim 7, wherein said second mounting means includes a first axial portion having a first diameter, and an adjacent second axial portion having a relatively smaller second diameter.

* * * * *